United States Patent [19]

Emadi et al.

[11] Patent Number: 4,895,535

[45] Date of Patent: Jan. 23, 1990

[54] KEYED MOUNTABLE ELECTRICAL CONNECTORS

[75] Inventors: Atahusain Emadi, Carlisle; Daniel J. Mignogna, Harrisburg, both of Pa.

[73] Assignee: AMP Incorporated, Harrisburg, Pa.

[21] Appl. No.: 362,736

[22] Filed: Jun. 7, 1989

[51] Int. Cl.[4] ..... H01R 13/645

[52] U.S. Cl. ..... 439/681; 439/562; 439/607

[58] Field of Search ..... 439/677, 680, 681, 544, 439/562, 569, 571, 572, 573, 92, 97, 904, 607, 610

[56] References Cited

U.S. PATENT DOCUMENTS

| | | | |
|---|---|---|---|
| 2,902,665 | 9/1959 | D'Amico | 339/92 |
| 3,177,461 | 4/1965 | Hagan et al. | 339/184 |
| 3,426,315 | 2/1969 | De Tar | 339/105 |
| 3,491,330 | 1/1970 | Barnhart et al. | 339/184 |
| 3,555,491 | 1/1971 | Moss | 339/92 |
| 3,582,867 | 6/1971 | Thompson et al. | 339/92 |
| 3,594,698 | 7/1971 | Anhalt | 339/75 M |
| 4,159,862 | 7/1979 | Funck et al. | 339/186 M |
| 4,181,391 | 1/1980 | Kilsdonk | 339/92 M |
| 4,277,126 | 7/1981 | Lincoln | 339/186 M |
| 4,519,667 | 5/1985 | Canning et al. | 339/186 M |
| 4,715,829 | 12/1987 | Preputnick | 439/660 |
| 4,778,411 | 10/1988 | Rudy, Jr. et al. | 439/631 |
| 4,822,305 | 4/1989 | Waters | 439/681 |

FOREIGN PATENT DOCUMENTS

| | | |
|---|---|---|
| 961714 | 6/1964 | United Kingdom . |
| 1089073 | 11/1967 | United Kingdom . |

OTHER PUBLICATIONS

AMP Catalog No. 81-655 "AMP-HDI 2-piece PC Board Connectors".

AMP Catalog No. 79-547 "AMP Subminature D Pin and Socket Connectors per mil-c-24308 (Amplimite)".

*Primary Examiner*—Eugene F. Desmond
*Assistant Examiner*—Walter G. Hanchuk
*Attorney, Agent, or Firm*—Anton P. Ness

[57] ABSTRACT

A system of keying of a panel mounted connector and a mating connector is provided where each of the connectors is of the type having forward and rearward thin walled metal shells clinched together about their flanged edges to retain a housing means therewithin, with the forward and rearward shells having adjacent apertured lateral flanges enabling mounting of either one of the connectors to a panel at an I/O port of an electronic apparatus by screw means. The keying system includes a pair of key members each securable to the front of the forward shell at a respective lateral flange, by the corresponding screw means extending through the apertures of the rearward and forward shell flanges and threaded into a threaded key member aperture. The key members may have octagonal cross-sections and are seated within correspondingly octagonally shaped flange apertures of the forward shell only, held against the front surface of the rearward shell. The screw means for the connector to be panel mounted comprise the panel mounting means and extend first through respective panel holes adjacent the panel cutout and aligned with the shell flange apertures.

6 Claims, 3 Drawing Sheets

KEYED MOUNTABLE ELECTRICAL CONNECTORS

FIELD OF THE INVENTION

The present invention relates to the field of electrical connectors and more particularly to connectors which are mountable to a panel.

BACKGROUND OF THE INVENTION

Certain electrical connectors are mountable to panels such as housings of electronic apparatus such as computer terminals, extending through panel cutouts such as at an input/output ports. Such connectors are to be mated to mating connectors on one side of the panel, with mating arrays of terminals thereof to become electrically engaged along connector mating faces, and having their terminals connected on the other side of the panel such as to a plurality of conductors of a printed circuit board or to wires along a wire receiving face. Where a plurality of similar such connectors are mounted in an array to a panel, for mating to a like plurality of mating connectors, the connectors must be labeled or otherwise visibly marked to indicate which of the mating connectors all similar in appearance and shape, are to mate with which of the mounted connectors all similar in appearance and shape.

It would be desirable to provide a means to mechanically prevent all but the particular mating connector from being mated to a particular mounted connector. Types of connectors are known in which cooperating keying structures are utilized which are shaped and positioned and correspondingly oriented along the respective mating faces of the pair of connectors to allow mating when the two connectors matchingly keyed are being moved axially together, but abut and physically obstruct mating when two connectors are being moved together which are not matchingly keyed.

Such keys are usually used in pairs matable with corresponding pairs and usually have body sections which are hexagonal or octagonal in cross-sectional shape, and the keys of each pair are secured to a respective one of the connectors with their body sections in apertures of the connector housing which are correspondingly shaped in cross-section; thus each key can be secured in its respective aperture in any one of six or eight different positions. Each key includes a keying projection extending axially forwardly from the octagonal body section but only extending around one half of the circumference; the corresponding key will have a keying projection which will enter the region comprising the other one half of the circumference, when the two connectors which are matchingly keyed are moved axially together. By coordinating the selection of positions of the two keys of each connector of the pair desired to be matable, the keys provide a means for physically encoding the mating faces of the pair of connectors.

In one type of panel-mountable connector and matable connector, one of them includes a forward plug section of the terminal housing which is D-shaped in transverse cross-section to be received in a cavity of the other upon mating, with the cavity being correspondingly D-shaped. Each of the housings is secured within metal front and rear shell members each of which is stamped and drawn or stamped and formed, defining a central housing-receiving cavity within which the dielectric housing is placed, after which the shells are secured to each other thus holding the housing therewithin. The front and rear shells include flanges extending transversely outwardly from the housing-receiving cavity to abut a transverse surface of the panel to which the panel-mountable connector is to be mounted, surrounding the panel cutout, and including a pair of lateral flange sections including apertures through which extend mounting fasteners such as mounting screws to hold the connector to the panel. The front shell of one of the matable pair of connectors includes a forwardly extending hood section which comprises the D-shaped plug-receiving cavity; the front shell of the other connector also has a D-shaped forwardly extending section slightly smaller to be receivable into the cavity, and which contains the housing's plug section.

One such pair of connectors is a product sold by AMP Incorporated under Part Nos. 208743-1 and 208552-1. In the AMP product the front and rear shells are secured together by a pair of small tabs extending outwardly from the edge of each lateral flange section of one of the shells being bent around the corresponding flange section of the other shell so that the shell members are clinched together at each end.

It is desired to provide keying for a mating pair of shielded connectors one of which is mountable to a panel, where the key or keys do not occupy any of the space across the mating face of the connectors, which is desired to be occupied only by contact sections of matable terminals of the connectors.

SUMMARY OF THE INVENTION

The present invention provides for securing the keys to the connectors away from the mating faces thereof, by securing the keys to the lateral mounting flanges defined by the shell members. For a pair of octagonal keys, for example, to provide for sixty-four different keying arrangements, the mounting aperture of each mounting flange of the front shell member is a correspondingly octagonal shape stamped into the metal, while the mounting aperture of the rear shell member remains conventionally circular. When the connector has been assembled with the dielectric housing within the front and rear shells clinched together, the connector is placed on the mating side of the panel at the cutout so that the shell flanges are on the mating panel side around the cutout.

Each of the short mounting screws extend through a corresponding panel hole beside the cutout and through the circular hole of the rear shell and through the octagonal hole of the front shell. The key member has a threaded aperture therethrough and is seated within the octagonal hole of the front shell in a selected one of the eight positions, so that the threaded key aperture is aligned with the mounting hole of the rear shell. The mounting screw is threaded into and through the key aperture. The mounting screw acts to hold the key member to the connector, and the key member acts to hold the mounting screw and the connector to the panel. The short mounting screw extends only halfway along the keying projection so that it does not abut the corresponding mounting screw of the mating connector securing the corresponding key member to the mating connector in the opposed keying position. Upon connector mating the key members will permit mating as the appropriately positioned keying projections pass by each other as the connectors are moved axially together.

It is an objective to provide a system of keying for the type of D-shaped shielded connector which is mountable to a panel.

It is also an objective for the system of keying to be a mechanical keying system instead of a system requiring labeling or other visible indicia to indicate the propriety of mating a seemingly matable connector pair.

It is a further objective to provide for keying without occupying any portion of the mating face of the housing of the connector.

It is additionally an objective of providing such keying without increasing the outer dimensions of the shell flanges commonly in use with the prior art connectors, thus not increasing the amount of panel space occupied by the connector assembly, facilitating close connector spacing.

It is also additionally an objective to provide the consumer of the connectors of the present invention the ability to arrange the particular coding of connector pairs selected to be correspondingly keyed and particularly matable, without increasing the number of parts needed to assemble a keyed connector and without unduly increasing the complexity of panel mounting.

An embodiment of the present invention will now be described with reference to the accompanying drawings.

DETAILED DESCRIPTION OF THE PREFERRED EMBODIMENT

Figure 1:
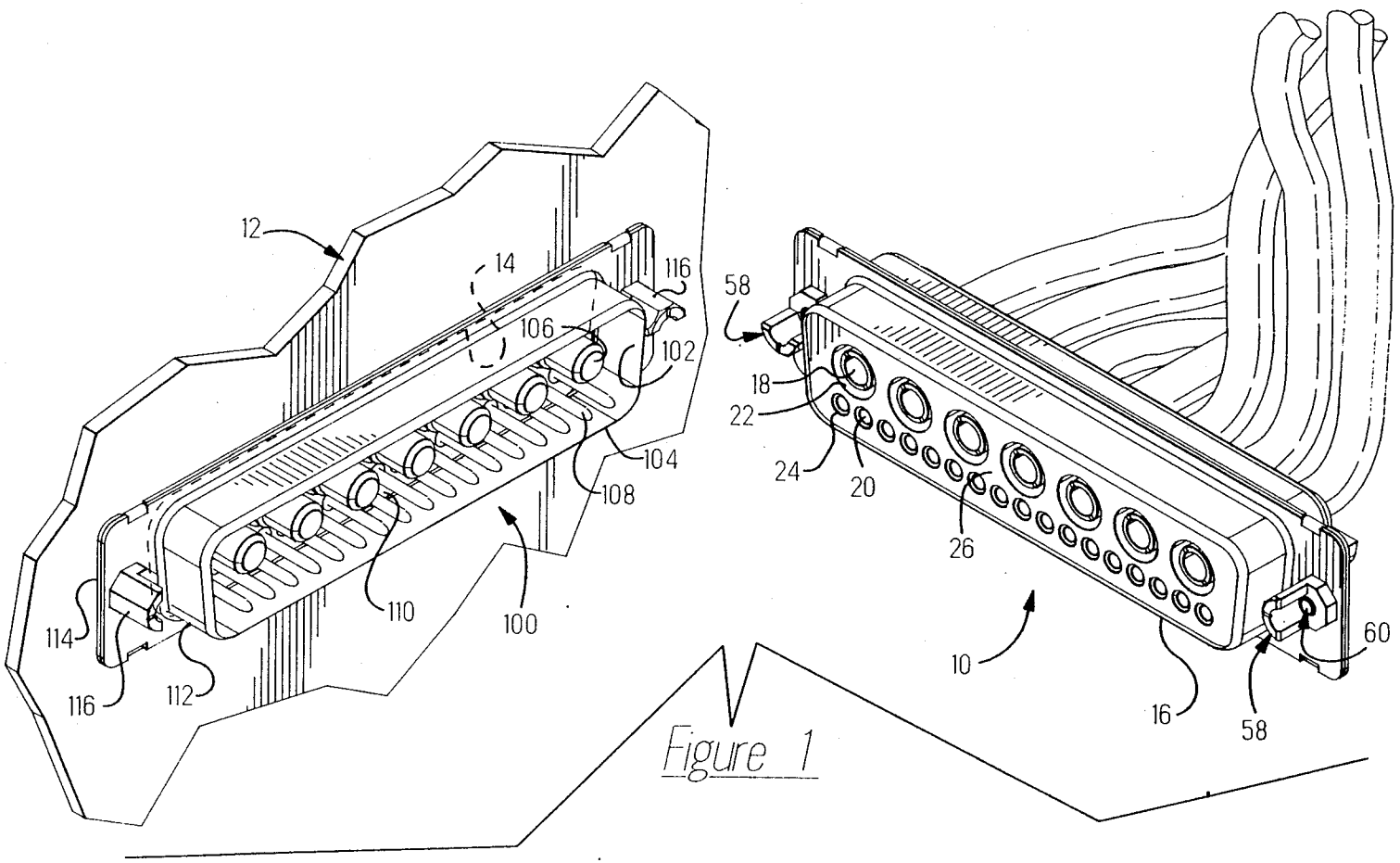
FIG. 1 shows a matable pair of connectors which are matchingly keyed according to the present invention.

A pair of matable electrical connectors 10,100 are shown in FIG. 1 which are matchingly keyed, according to the present invention. Connector 100 is shown mounted to a panel 12 through a cutout 14 (in phantom), where panel 12 typically is a housing of an electronic apparatus such as a computer terminal (not shown), and cutout 14 is commonly referred to as an input/output port (I/0). Connector 10 has a forward plug section 16 which is receivable into large cavity 102 of hood section 104 of connector 100 upon mating; forward plug section 16 and hood section 104 are correspondingly dimensioned and D-shaped for polarization so that mating of the connectors occurs when both connectors are appropriately oriented with respect to each other, as is known. Forward plug section 16 has a plurality of terminals 18,20 having socket contact sections disposed in passageways 22,24 in communication with mating face 26 of connector 10, while connector 100 has a like plurality of terminals 106,108 having pin contact sections extending forwardly from mating face 110 within hood section 104 which will be received into entrances to passageways 22,24 and into the socket contact sections of terminals 18,20 of connector 10 upon mating. Connectors 10,100 are held in their mated condition by the collective frictional forces of the spring beams of the socket contact sections of terminals 18,20 on the pin contact sections 106,108 required to provide assured electrical connections between the mating terminals.

Figure 2:
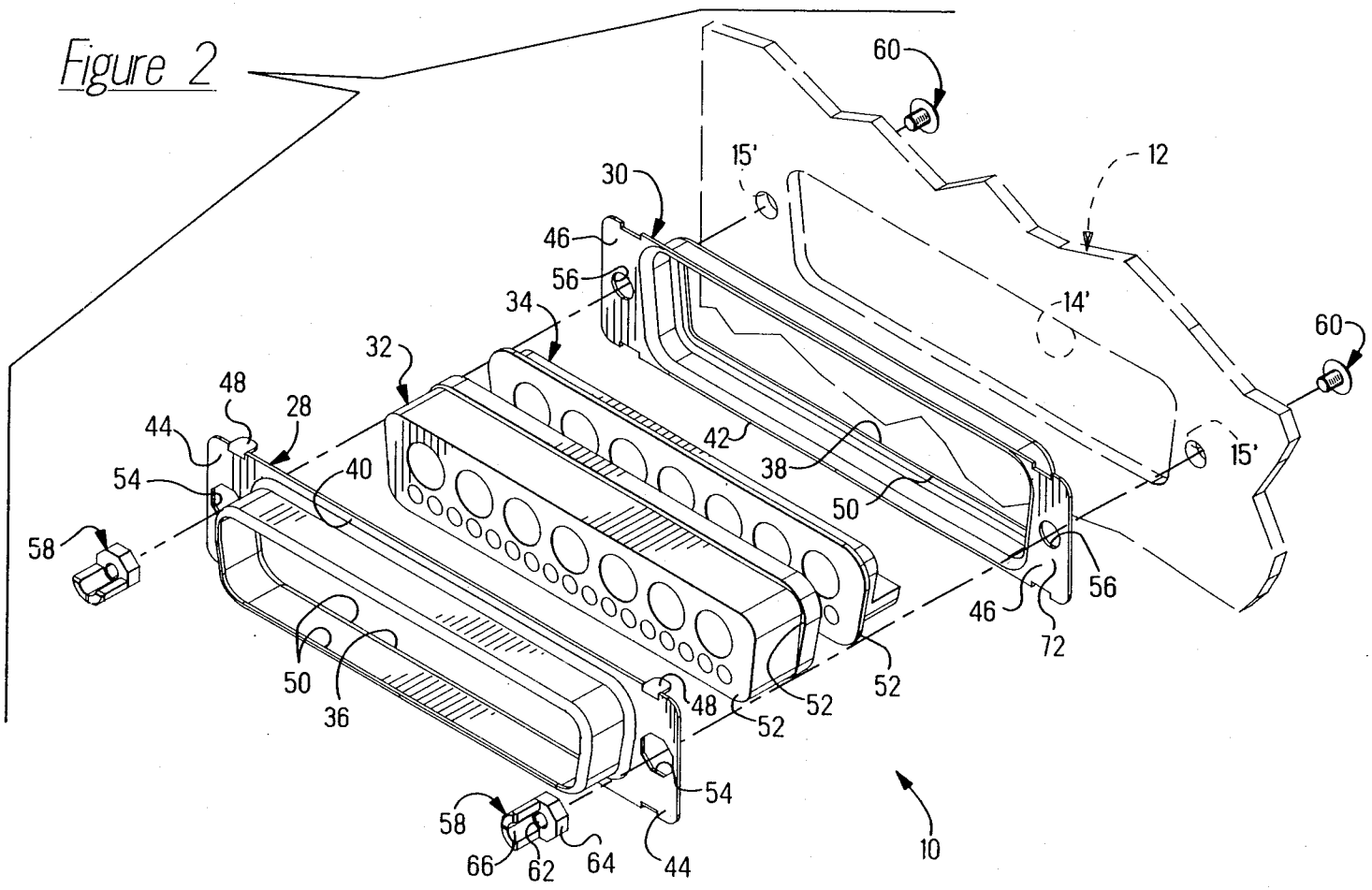
FIG. 2 is an exploded view of one of the connectors of FIG. 1.

Referring to FIG. 2, connector 10 includes a forward shell member 28 and and a rearward shell member 30 which together define a protective shell containing housing inserts 32,34 and terminals 18,20 (FIG. 1). In AMP Part Nos. 208743-1 and 208552-1 shell members 28,30 are stamped and drawn from steel into thin-walled members and then preferably cadmium plated. Shell members 28,30 include respective housing apertures 36,38 extending axially therethrough and transverse peripheral flanges 40,42 surrounding housing apertures 36,38, and extending laterally from opposed ends of the shell members are lateral flanges 44,46. Forward shell member 28 includes a pair of clinching tabs 48 along edges of both lateral flanges 44, which are bent over corresponding edges of rearward shell member 30 to secure the shell members together, with housing inserts 32,34 held therebetween in housing apertures 36,38 by ledge portions 50 of peripheral flanges 40,42 against insert edges 52, as is known in the prior art. Through lateral flanges 44,46 extend holes 54,56 aligned with each other, and a connector of the prior art having such shell members can be mounted as desired to a panel (such as 12' in phantom having a cutout 14') by a pair of mounting screws and corresponding nuts (not shown), with the screws extending through panel holes 15' and through apertures in the lateral flanges of the clinched shells of the connector.

Connector 100 of FIG. 1 is similarly constructed, with forward and rearward shell members 112,114 having apertured lateral flanges for panel mounting, if it is desired that connector 100 be panel mounted rather than connector 10.

In accordance with the present invention, connector 10 includes a pair of key members 58 secured to the forward faces of lateral flanges 44 of forward shell member 28, by a pair of short screws 60 which extend through holes 56,54 from the rear face of rearward shell member 30, and through threaded apertures 62 of key members 58. Connector 100 likewise includes a pair of key members 116 positioned to align with key members 58 when connectors 10,100 are moved axially together during mating. The key members 58 of connector 10 and key members 116 of connector 100 are angularly oriented to cooperate with each other to permit mating since connectors 10,100 are desired to be matable and have been matchingly keyed; if any of the mating key members of one connector were not angularly oriented to correspond with the key member of the other connector, the key members would abut before the connectors and their terminal arrays could mate, which would mechanically prevent a mated condition.

Figures 3, 4:
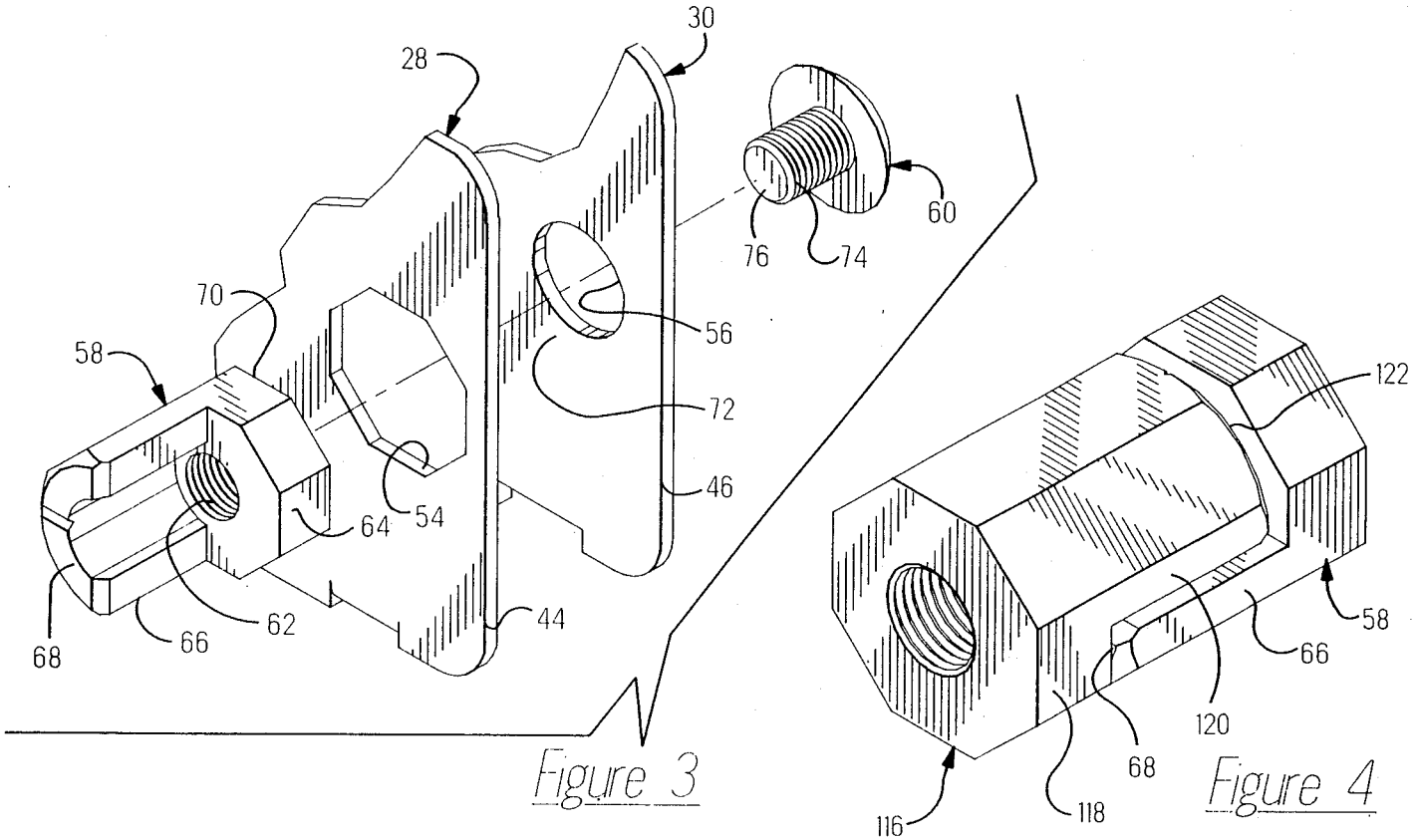
FIGS. 3 and 4 are enlarged views of a key member usable with the present invention, and of a pair of key members in mated condition.

As seen in FIGS. 3 and 4, each key member 58,116 includes a rearward body section 64,118 having an octagonal shape in cross-section, forwardly from which extends a keying projection 66,120. Keying projection 66,120 is generally semicylindrical extending about one half of the circumference forwardly to a forward face 68,122. In FIG. 4 when a key member 58 meets a corresponding key member 116 during connector mating, the keying projections 66,120 will pass by each other because the angular orientations of the members have been fixed to cooperate with each other. If the angular orientations of the associated key members were not fixed for the connectors to be matchingly keyed, the forward faces 68,122 would abut and not permit the connectors to be moved fully together into a mated condition.

Each key member 58 is held in its selected angular orientation within a seating recess of corresponding octagonal cross-section, which consists of hole 54 in forward shell member 28 stamped to have an octagonal shape, while hole 56 of rearward shell member 30 has a circular shape of smaller dimensions. The rearward face 70 of key member 58 is held against the front face 72 of rearward shell member 30 when a short screw 60 is assembled to connector 10 to mount connector 10 to panel 12 as shown in FIG. 2. Short screws 60 have threaded shanks 74 with axial lengths selected to extend to front ends 76 at least through threaded apertures 62 of key members 58 but not further than halfway along keying projections 66, thus preempting abutting the fronts of the screws holding key members 116 to connector 100 which may have interfered with connector mating even if the key members were matchingly keyed.

In use the connectors are mounted to the panel 12 during assembly of the electronic apparatus, and the angular orientations of each key member 58 of each of the connectors 10 being panel mounted is selected during apparatus assembly. This assures that each panel mounted connector 10 in an array of up to sixty-four like connectors 10 can be physically coded to be distinct from others of the same array. With each connector 10 being polarized by the D-shaped forward plug section 16 and having two key members 58 of octagonal shapes, sixty-four coding possibilities exist; if hexagonal keys are used, then thirty-six coding possibilities would exist. Keys may also be used which have cross-sectional shapes of other regular polygons. The connectors 100 desired to be matchingly keyed to particular ones of panel mounted connectors 10 can then have their key members 116 correspondingly positioned and secured to the connectors 100 by short screws. While each connector 10 may be labeled, the keying system of the present invention provides for mechanical coding to prevent non-matchingly keyed connectors from being mated.

The keyed connectors described herein represent the preferred embodiment of the present invention, but it is understood that variations and modifications of the connectors may be made which are within the spirit of the invention and the scope of the claims.

What is claimed is:

1. An improved electrical connector of the type having forward and rearward metal shells surrounding and retaining therewithin a terminal housing means and exposing a mating face of the housing means for mating with a matable connector and a rearward face adapted to provide for electrical connection of the connector terminals with respective conductive means, the shells being securable together and having abutting apertured lateral flanges, the improvement comprising:

a pair of key members adapted to be secured along the front surfaces of said lateral flanges of said forward metal shell, each key member having a threaded aperture therethrough to be threadably engaged by a corresponding threaded shank of said mounting means, and each key member having a body section having a cross-sectional shape of a selected regular polygon and defining a rear mounting face, and each key member further having a keying projection extending forwardly from said body section around approximately one half of the circumference about said threaded aperture to a front face;

each aperture through said lateral flanges of said forward metal shell having a cross-sectional shape corresponding to said selected regular polygon comprising the cross-sectional shape of said key member body section enabling said key member body section to be inserted therewithin, and each aperture through said lateral flanges of said rearward metal shell being smaller than and centered with respect to the corresponding said forward metal shell aperture, so that the periphery of said rearward metal shell aperture defines a seating surface against which said rearward face of a said key member will be held by said mounting means;

the shank portion of each said mounting means adapted to extend through a corresponding said rearward metal shell aperture, and through a corresponding said forward metal shell aperture to be threaded into a corresponding said threaded key member aperture and having a length at least less than the length of said keying projection, after said corresponding key member has been seated within said forward metal shell aperture to have the desired angular orientation, whereby a keyed connector is defined matable with a mating matchingly keyed connector when said mounting means extend through said corresponding rearward and forward metal shell apertures and said corresponding threaded key member aperture.

2. An electrical connector as set forth in claim 1 wherein said selected regular polygon shape is octagonal.

3. An improved assembly of an electrical connector and a panel, the electrical connector being of the type having forward and rearward metal shells surrounding and retaining therewithin a terminal housing means and exposing a mating face of the housing means for mating with a matable connector and a rearward face adapted to provide for electrical connection of the connector terminals with respective conductive means, the shells being securable together and having abutting apertured lateral flanges enabling mounting to the panel by mounting means so that the connector extends through a cutout of the panel with the mating face along one side of the panel and the rearward face along the other side, the improvement comprising:

a pair of key members secured along the front surfaces of said lateral flanges of said forward metal shell, each key member having a threaded aperture therethrough threadedly engaged by a corresponding threaded shank of a respective said mounting means, and each key member having a body section having a cross-sectional shape of a selected regular polygon and defining a rear mounting face, and each key member further having a keying projection extending forwardly from said body section around approximately one half of the circumference about said threaded aperture to a front face;

each aperture through said lateral flanges of said forward metal shell having a cross-sectional shape corresponding to said selected regular polygon comprising the cross-sectional shape of said key member body section enabling said key member body section to be disposed therewithin, and each aperture through said lateral flanges of said rearward metal shell being smaller than and centered with respect to the corresponding said forward metal shell aperture, so that the periphery of said rearward metal shell aperture defines a seating surface against which said rearward face of a said key member is held upon mounting of said connector to said panel; and the shank portion of each said mounting means extending through a corresponding panel aperture adjacent said cutout, through a corresponding said rearward metal shell aperture, and through a corresponding said forward metal shell aperture and threaded into a corresponding said threaded key member aperture and having a length selected extending no more than one half the length of said keying projection, after said corresponding key member has been seated within said forward metal shell aperture to have the desired angular orientation, whereby a keyed panel mounted connector assembly is defined matable with a mating matchingly keyed connector.

4. An improved assembly as set forth in wherein said selected regular polygon shape is octagonal.

5. An improved assembly of a panel mounted electrical connector and a mating electrical connector, the electrical connectors both being of the type having forward and rearward metal shells surrounding and retaining therewithin a terminal housing means and exposing a mating face of the housing means for mating with the other connector and a rearward face adapted to provide for electrical connection of the connector terminals with respective conductive means, the forward and rearward shells being securable together and having abutting apertured lateral flanges, the lateral flanges of either connector enabling mounting to the panel by mounting means so that the connector extends through a cutout of the panel with its mating face along one side of the panel and its rearward face along the other side, the improvement comprising:

each of said panel mounted electrical connector and said mating electrical connector being improved by:

(a) a pair of key members secured along the front surfaces of said lateral flanges of said forward metal shell, each key member having a threaded aperture therethrough threadedly engaged by a corresponding threaded shank of a respective said mounting means, and each key member having a body section having a cross-sectional shape of a selected regular polygon and defining a rear mounting face, and each key member further having a keying projection extending forwardly from said body section around approximately one half of the circumference about said threaded aperture to a front face; and (b) each aperture through said lateral flanges of said forward metal shell having a cross-sectional shape corresponding to said selected regular polygon comprising the cross-sectional shape of said key member body section enabling said key member body section to be disposed therewithin, and each aperture through said lateral flanges of said rearward metal shell being smaller than and centered with respect to the corresponding said forward metal shell aperture, so that the periphery of said rearward metal shell aperture defines a seating surface against which said rearward face of a said key member is held upon mounting of said connector to said panel;

the shank portion of each said mounting means of the mating connector extending through a corresponding said rearward metal shell aperture, and through a corresponding said forward metal shell aperture and threaded into a corresponding said threaded key member aperture, said corresponding key member having been seated within said forward metal shell aperture;

the shank portion of each said mounting means of said panel mounted connector extending through a corresponding panel aperture adjacent said cutout, through a corresponding said rearward metal shell aperture, and through a corresponding said forward metal shell aperture and threaded into a corresponding said threaded key member aperture, said corresponding key member having been seated within said forward metal shell aperture;

correspondingly opposing ones of said key members of said panel mounted connector and said mating connector having been seated to have corresponding angular orientations matchingly keyed to permit mating of said connectors when said mating connector is moved axially against said panel mounted connector; and correspondingly opposed ones of said mounting means having lengths selected to be short enough not to abut each other when said connectors are moved axially together, whereby an assembly is defined of a keyed panel mounted connector assembly and a keyed connector assembly matable therewith.

6. An improved assembly as set forth in claim 5 wherein said selected regular polygon shape is octagonal.

* * * * *

UNITED STATES PATENT OFFICE

CERTIFICATE OF CORRECTION

Patent No. 4,895,535 Dated January 23, 1990

Inventor(s) Atahusain Emadi et al.

It is certified that error appears in the above-identified patent and that said Letters Patent is hereby corrected as shown below:

Column 7, Claim 4, Line 16 - After the word "in" insert "claim 3".

Signed and Sealed this

Eighth Day of October, 1991

*Attest:*

HARRY F. MANBECK, JR.

*Attesting Officer*

*Commissioner of Patents and Trademarks*